United States Patent [19]

Sauber

[11] Patent Number: 4,761,852

[45] Date of Patent: Aug. 9, 1988

[54] HINGE FOR VEHICLE PANEL DOOR

[76] Inventor: Charles J. Sauber, 10 N. Sauber Rd., Virgil, Ill. 60182

[21] Appl. No.: 909,240

[22] Filed: Sep. 19, 1986

Related U.S. Application Data

[63] Continuation-in-part of Ser. No. 796,800, Nov. 12, 1985, abandoned.

[51] Int. Cl.[4] ..... E05D 7/04; E05D 11/02; E05D 5/12

[52] U.S. Cl. ..... 16/237; 16/249; 16/251; 16/267; 16/380; 16/382; 16/248; 16/247; 16/273

[58] Field of Search ..... 16/223, 234, 246, 249, 16/250, 251, 267, 268, 380, 381, 382, 383, 384, 386, 237, 248, 238, 239, 247, 2, 273; 296/216, 218

[56] References Cited

U.S. PATENT DOCUMENTS

| | | | |
|---|---|---|---|
| 722,344 | 3/1903 | Wirt | 16/251 |
| 2,169,059 | 8/1939 | Soss et al. | 16/251 |
| 3,229,323 | 1/1966 | Hensgen | 16/247 |
| 3,416,185 | 12/1968 | Peterson | 16/267 |
| 4,064,595 | 12/1977 | McLeish Leaver | 16/234 |
| 4,130,966 | 12/1978 | Kujawa, Jr. et al. | 296/218 |

FOREIGN PATENT DOCUMENTS

| | | | |
|---|---|---|---|
| 804575 | 10/1936 | France . | |
| 1234823 | 10/1960 | France | 16/273 |

*Primary Examiner*—Nicholas P. Godici
*Assistant Examiner*—Edward A. Brown
*Attorney, Agent, or Firm*—Leydig, Voit & Mayer

[57] ABSTRACT

A hinge comprised of a door leaf, a body leaf, and required shims, which support and asist in pivoting a vehicle panel door. The door leaf is uniquely constructed, having extended parallel portions on each side of the wide end connected by an integrally formed hinge pin, creating a door leaf slot with said integral pin being the axis of rotation for said door. Alternatively, two underside projections on said door leaf near the narrow end or a T-slot, serve as fastener receiving means when the hinge is attached to said vehicle panel door. The body leaf has a semi-circular knuckle portion that serves as a sleeve within which sid integral hinge pin said door leaf rotates. Two projections on the mounting portion of said body leaf are fastener receiving means when said body leaf is attached to said vehicle panel body.

11 Claims, 2 Drawing Sheets

HINGE FOR VEHICLE PANEL DOOR

This application is a continuation-in-part of the prior U.S. application Ser. No. 796,800, filed Nov. 12, 1985, now abandoned.

BACKGROUND OF THE INVENTION

This invention relates to vehicle panel door hinges, more particularly, hinges utilized on access panel doors for truck bodies.

In the past hinges designed for this purpose were generally more complicated in construction comprised of a door leaf with alternating hinge curls and a body leaf with alternating hinge curls. These leaves were meshed together and interconnected with a connecting pin extending vertically downward through the alternating hinge curls. Oftentimes this pin was loose within said curls or screwed into the bottom curl. Such construction, while necessarily complicated in its manufacture, also permitted a certain lack of security in that mere removal of the pin would defeat the hinge. Additionally, a variety of mounting methods offered exposed bolts and screws which attached this type of hinge to the door and could also easily be removed, thus defeating the hinge.

Another problem encountered in the prior art is that the hinge action frequently pinched, compressed, or otherwise deformed weather stripping material which was used to seal the door when the door was closed. This pinching minimized the effectiveness of the weather stripping.

SUMMARY OF THE INVENTION

The principle object of the present invention is to provide an improved hinge device which offers simplified construction, increased security, and higher degree of protection to integral weather stripping on a vehicle door. This object is accomplished through simplified construction of the hinge into two primary parts, a door leaf and a body leaf which interconnect through the use of an integral hinge pin. A nylon shim or liner may be affixed to the underside of the body leaf to minimize friction and permit smooth rotation. Spacer plates are also available to adapt to any curvature of the vehicle body thereby adding to the versatility of mounting the hinge. Added security is gained by having all mounting bolts or screws covered by the hinge device when the vehicle door is in the closed position, thereby leaving no exposed nuts or bolts on the exterior surfaces. The unique design of the present hinge invention shifts the hinging action into such a position that weather stripping around the door and the body are not affected by opening and closing.

BRIEF DESCRIPTION OF THE DRAWINGS

The attached drawings illustrate the preferred embodiment of the invention, without limitation thereto. In the drawings, like elements are identified by like reference symbols in each of the views, and.

DESCRIPTION OF THE PREFERRED EMBODIMENT

In accordance with the present invention there is provided a basically two part hinge, generally indicated at 10, having an elongated door leaf 13 with an integrally formed hinge pin 17 at one end, and a knuckle body leaf 14 adapted to underlie the door leaf 13 and mountable to the body 12.

Figure 1:
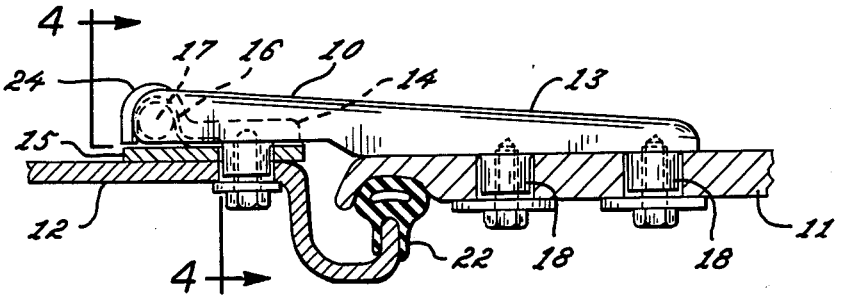
FIG. 1 is a cross-sectional view of the hinge mounted on a vehicle door, in the closed position.
Figure 2:
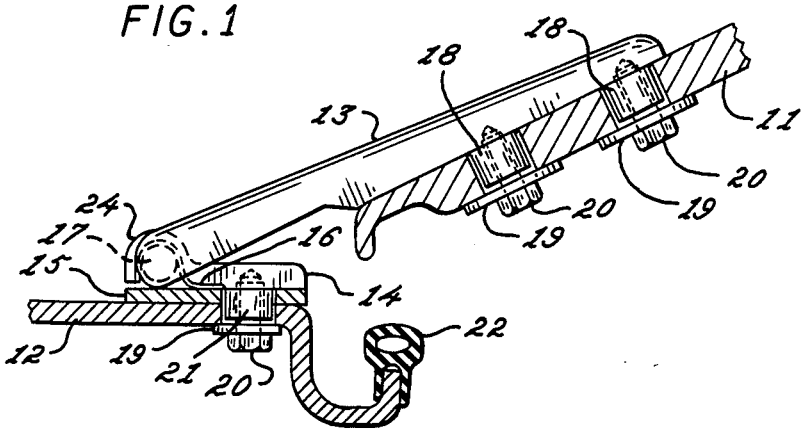
FIG. 2 is a cross-sectional side view of the hinge mounted on a vehicle door, in the open position.
Figure 4:
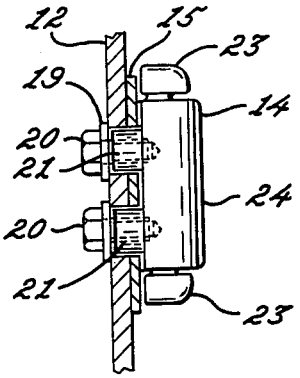
FIG. 4 is a side plan view taken along line 4—4 of the hinge mounted on a vehicle door, in the closed position.
Figure 3:
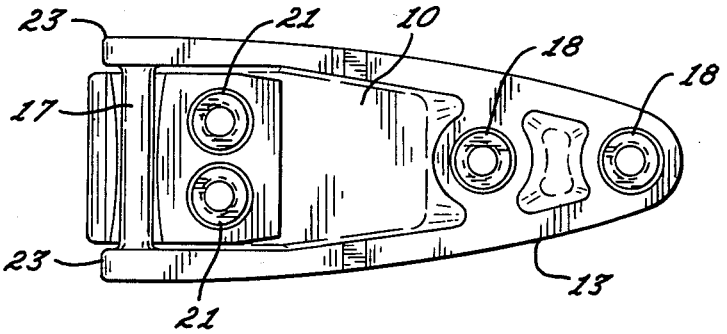
FIG. 3 is a bottom plan view of the hinge mounted on a vehicle door, in the closed position, showing the interconnection of the hinge leaves.

Referring to FIG. 1, the hinge 10 is depicted attached to the door 11 and body 12 of a truck body with the door 11 in the closed position. The elongated door leaf 13 is of unitary form, such as cast metal, having at one end parallel extensions 23 as shown in FIG. 3, on each side transversely connected by a cylindrical bar which serves as an integrally formed hinge pin 17 and axis of rotation for the hinge as seen in FIGS. 1 and 2. In order to mount the door leaf 13 on the door 11, on the opposite end of the door leaf 13, along the central horizontal axis of the leaf, are positioned two projections 18 which serve as fastener receiving means.

The body leaf 14 is also of unitary form, such as cast metal, having at one end a semi-circular knuckle 24 for the rotation of the integral hinge pin 17 of the door leaf 13. A nylon shim or liner 16 may be affixed to the underside of the body leaf 14 which reduces the friction between the semi-circular knuckle 24 and the integrally formed hinge pin 17 enabling smooth rotation. On the flat mounting portion of the body leaf 14 oriented along the vertical axis are two projections 21 which serve as fastener receiving means when the body leaf 14 is mounted to the body 12 of the vehicle.

The hinge 10 is mounted in the following manner: The edge of the semi-circular knuckle portion of the body leaf 14 is inserted, with the projections 21 facing downward, into the reverse side of the door leaf 13 with projections 18 facing upward, into the slot formed between the main body of the door leaf 13 and the integrally formed hinge pin 17 and the body leaf rotated counter-clockwise around the integral hinge pin 17, thereby interconnecting the door leaf 13 and the body leaf 14 with the hinge pin 17 as the axis of rotation. Mounting holes corresponding to the location of the projections on both leaves must be drilled into or formed on the vehicle body 12 and door 11. Fastener means 20, with washers 19, are tightened into the drilled and tapped projections 18, 21 from inside the truck body.

Figure 5:
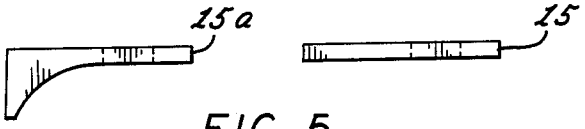
FIG. 5 is a side plan view of the spacer plates.
Figure 6:
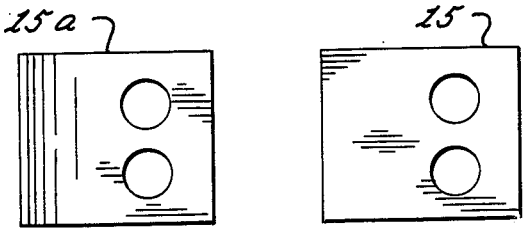
FIG. 6 is a top plan view of the spacer plates.
Figure 7:
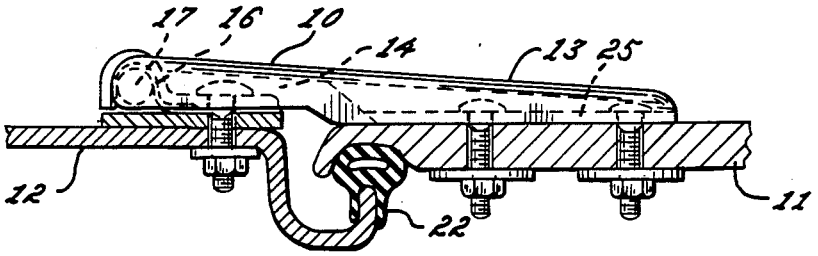
FIG. 7 is a cross-sectional view of the hinge in the additional embodiment configuration mounted on a vehicle door, in the closed position.

In certain instances, depending upon the curvature of the open edge of the vehicle body 12 or to change the off-set mounting of the hinge, spacer plates 15, **15*a* as illustrated in FIG. 5 and FIG. 6, are provided for insertion between the body leaf 14 and the body 12**. Spacer plate 15*a* as here shown on the left in FIGS. 5 and 6 is adapted to fit a curvature in a body. Holes have been drilled into the spacer plates 15, 15*a* corresponding with the projections 21 on the body leaf 14. Using fastener means 20 and washers 19, the door leaf 14 is fixed to the body 12 in the same manner as with the body leaf 13. It will be appreciated that where the spacer plates are utilized, it may be desirable to provide sleeve-like extensions (not shown) attachable to the projections 18, 21 so that the added thickness due to the spacer plates 15, 15*a* will not cause difficulties when attaching to the fasteners 20.

When the door is in the closed position, the weather stripping 22 around the door 11 is compressed effecting a weather seal as shown in FIG. 1.

An important aspect in the present invention can clearly be noticed in that the fastener means 20 are not exposed on the exterior side of the hinge 10. This feature significantly enhances the security of the hinge in that removal can only be initiated from inside the vehicle body. With the hinge 10 firmly attached, another important aspect of the invention is clearly visible. As a result of the placement and construction of the hinge 10, the hinging action has been shifted from the interface between the door 11 and the body 12 to the new spaced and off-set axis of rotation provided by the integrally formed hinge pin 17 of the door leaf 12 within the semi-circular knuckle portion 24 of the body leaf 14. As can be seen in FIG. 1 and FIG. 2, the angular approach resulting from the spaced and off-set location of the hinge axis is substantially normal such that the weather stripping gasket 22, which acts as a seal between the body and the door, is not pinched or constricted. This feature permits complete sealing of the vehicle door 11 and body 12 when the door 11 is in a closed position as shown in FIG. 1.

Figure 8:
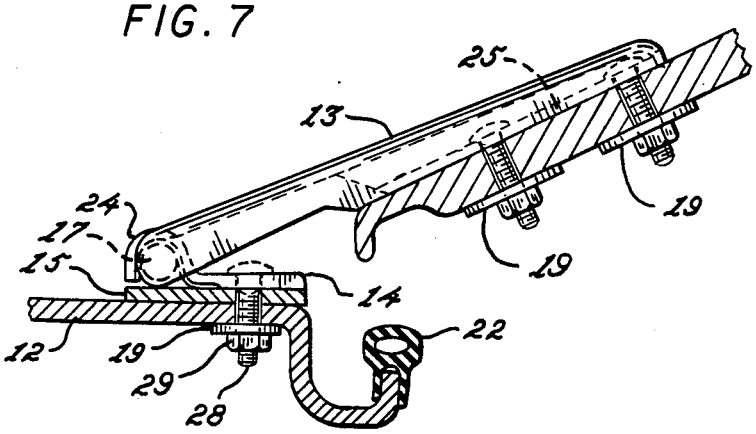
FIG. 8 is a cross-sectional view of the hinge in the additional embodiment configuration mounted on a vehicle door, in the open position.
Figure 9:
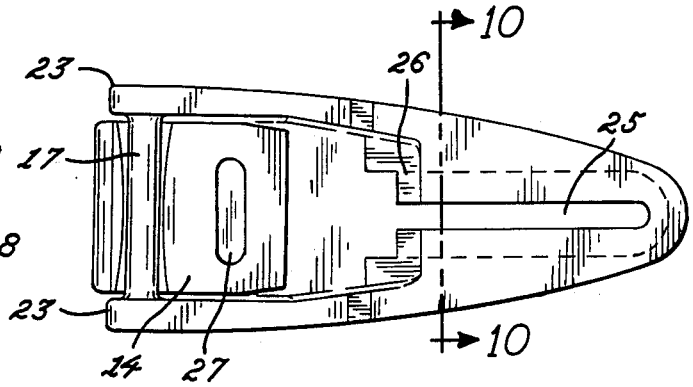
FIG. 9 is a bottom plan view of the underside of the hinge in the additional embodiment configuration; and, FIG. 10 is a side plan view of the hinge in the additional embodiment configuration taken along line 10—10.

An alternative embodiment is illustrated in FIG. 7 through FIG. 10 wherein the fastener receiving means consists of a longitudinal T-slot 25 on door leaf 13, having a supporting rim 26 which serves to hold the fastening means in position during mounting and tightening. The body leaf 14 has an elongated slot 27 oriented along the vertical axis of the flat mounting portion as shown in FIG. 9. In the present invention, the fastening means in this embodiment includes bolts 28, washers 19, and nuts 29 as shown in FIG. 8. Thus, the body leaf can be more readily shifted or adjusted to accommodate misalignments as well as to readjust the door with respect to the body.

The hinge 10 is mounted in the following manner: As with the first embodiment, mounting holes must be drilled into or formed on the vehicle body 12 and door 11. The body leaf 14 is initially loosely mounted to the body 12 by orienting the body leaf 14 with the semi-circular knuckle portion 24 away from the edge of the door and by positioning the elongated slot 27 in the body leaf 14 over the pre-drilled mounting holes in the body 12. Spacer plates 15, 15*a* may be used when required.

Figure 10:
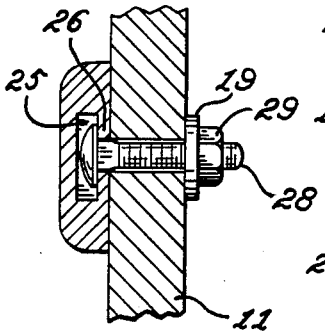

The door leaf 13 is mounted by inserting the integrally formed hinge pin 17 under the loosely mounted body leaf 14 so that the hinge pin 17 is secured under the semi-circular knuckle portion 24. Bolts 28 are inserted into slot 25 on the door leaf 13 and held in place by the rim 26. The door leaf 13 is rotated around the integrally formed hinge pin 17 and the bolts 28 aligned with and inserted into the pre-drilled mounting holes and nuts 29 and washers 19 attached as shown in FIG. 10. The bolts 28 on both the door leaf 13 and the body leaf 14 are then snuggly tightened to complete the mounting of the hinge 10.

I claim as my invention:

1. A hinge for a vehicle panel door to be pivotally mounted with respect to a vehicle body opening, comprising in combination, (a) an elongated door leaf having at one end an integrally formed hinge pin, said door leaf having fastener receiving means on its underside, said fastener receiving means being adapted to receive fasteners tightened from the rear side of the panel door and (b) a body leaf having a generally flat mounting portion and a semi-circular knuckle portion, the mounting portion having fastener receiving means for attaching the body leaf to the panel body, and (c) said semi-circular knuckle portion extending over and interconnecting with said integrally formed hinge pin and facing the vehicle body, whereby the hinge pin is inaccessible from the exterior of the hinge and thereby securing said door leaf for relative rotation about said body leaf the space between said semi-circular knuckle portion and said panel body being sized to prevent removal of the door leaf from the body leaf during rotation of the door leaf, said body leaf being rotatable about the hinge pin between a closed position wherein the body leaf mounting portion underlies and extends generally parallel to the elongated door leaf and an opened position wherein the body leaf mounting portion extends at an angle to the elongated door leaf.

2. A hinge as claimed in claim 1 wherein a friction reducing means is attached to the underside of said knuckle portion of said body leaf in order to reduce friction between said body leaf and said integrally formed hinge pin during rotation therebetween.

3. A hinge as claimed in claim 2 wherein said friction reducing means is a nylon liner.

4. A hinge as claimed in claim 1 wherein a height adjustment means is positioned to allow for proper alignment of said vehicle panel body and said vehicle panel door.

5. A hinge as claimed in claim 4 wherein said height adjustment means consist of shaped spacer plates adapted to the contours of said vehicle panel body.

6. A hinge as claimed in claim 1 wherein said fastener receiving means are adapted to receive said fasteners tightened from the rear side of said body panel.

7. A hinge as claimed in claim 1 wherein said fastener receiving means is comprised of an elongated T-slot and supporting lip to hold said fasteners in position.

8. A hinge as claimed in claim 7 wherein said fasteners are comprised of nuts and bolts.

9. A hinge as claimed in claim 1 wherein said fastener receiving means on said body leaf is a slot positioned on said flat mounting portion which permits realignment of said body leaf.

10. A hinge as claimed in claim 1 wherein the axis of said hinge is spaced from the interface between said vehicle panel door and said vehicle panel body providing an off-set axis of rotation by said integrally formed hinge pin of said door leaf within said semi-circular knuckle portion.

11. A hinge as claimed in claim 10 wherein said spaced and off-set hinge axis provides an angular approach which acts substantially normal to the weather insulating means between said vehicle panel door and said vehicle panel body thereby preventing pinching and crimping thereof.

* * * * *